US007355495B2

(12) United States Patent
Lo Hine Tong et al.

(10) Patent No.: US 7,355,495 B2
(45) Date of Patent: Apr. 8, 2008

(54) MICROWAVE FILTER COMPRISING A COAXIAL STRUCTURE WITH A METALLIZED FOAM HAVING A PERIODIC PROFILE

(75) Inventors: Dominique Lo Hine Tong, Rennes (FR); Ali Louzir, Rennes (FR); Philippe Chambelin, Chateaugiron (FR); Christian Person, Locmaria Plouzane (FR); Jean-Philippe Coupez, Le Relecq Kerhuon (FR)

(73) Assignee: Thomson Licensing, Boulogne Billancourt (FR)

( * ) Notice: Subject to any disclaimer, the term of this patent is extended or adjusted under 35 U.S.C. 154(b) by 113 days.

(21) Appl. No.: 10/540,147

(22) PCT Filed: Dec. 22, 2003

(86) PCT No.: PCT/FR03/50200

§ 371 (c)(1),
(2), (4) Date: Jun. 21, 2005

(87) PCT Pub. No.: WO2004/066429

PCT Pub. Date: Aug. 5, 2004

(65) Prior Publication Data

US 2006/0082426 A1 Apr. 20, 2006

(30) Foreign Application Priority Data

Jan. 3, 2003 (FR) ..... 03 00048

(51) Int. Cl.
*H01P 1/202* (2006.01)

(52) U.S. Cl. ..... 333/206

(58) Field of Classification Search ..... 333/206, 333/222, 245; 29/600
See application file for complete search history.

(56) References Cited

U.S. PATENT DOCUMENTS 2,641,646 A * 6/1953 Thomas ..... 333/206
2,911,333 A * 11/1959 Capen et al. ..... 29/600

(Continued)

FOREIGN PATENT DOCUMENTS

DE 3207422 9/1983

(Continued)

OTHER PUBLICATIONS

M. Sagawa, M. Makimoto, S. Yamashita: "A Design Method of Bandpass Filters Using Dielectric-Filled Coaxial Resonators" IEEE Trans. Microwave Theory Tech, vol. 33, No. 2, Feb. 1985, pp. 152-157.

(Continued)

*Primary Examiner*—Benny Lee
(74) *Attorney, Agent, or Firm*—Joseph J. Laks; Robert D. Shedd; Brian J. Cromarty

(57) ABSTRACT

The invention relates to a microwave filter comprising a coaxial structure, consisting of a tubular outer conductor and an inner bar conductor. According to the invention, the inner bar conductor extends in an axial direction inside the outer tube and, together with said tube, forms a series of concentric slots in the axial direction thereby defining successive coaxial line segments with low characteristic impedance and coaxial line segments with high characteristic impedance. The aforementioned concentric slots are produced in a synthetic foam block.

6 Claims, 1 Drawing Sheet

U.S. PATENT DOCUMENTS

| | | | | |
|---|---|---|---|---|
| 3,464,898 | A | 5/1966 | Norris | |
| 3,659,232 | A | 4/1972 | Foley | |
| 3,909,755 | A * | 9/1975 | Kaunzinger | 333/206 |
| 4,161,704 | A * | 7/1979 | Schafer | 333/33 |
| 2003/0001697 | A1 | 1/2003 | Bennett et al. | |

FOREIGN PATENT DOCUMENTS

| | | |
|---|---|---|
| GB | 1156931 | 7/1969 |
| JP | 59-013401 | 1/1984 |

OTHER PUBLICATIONS

R.E. Collins: "Foundations for Microwave Engineering (Second Edition)", 1992, McGraw-Hill, Singapore, pp. 551-552.
Search Report Dated Jul. 13, 2004.
Patent Abstracts of Japan, vol. 008, No. 095, May 2, 1984 & JP 59-013401 (Matsushita Denki Sangyo KK), Jan. 24, 1984 (See Ref. AG).

* cited by examiner

MICROWAVE FILTER COMPRISING A COAXIAL STRUCTURE WITH A METALLIZED FOAM HAVING A PERIODIC PROFILE

This application claims the benefit, under 35 U.S.C. § 365 of International Application PCT/FR03/50200, filed Dec. 22, 2003, which was published in accordance with PCT Article 21(2) on Aug. 5, 2004 in French and which claims the benefit of French patent application No. 0300048, filed Jan. 3, 2003.

The invention relates to a coaxial structure microwave filter comprising an outer conductive core and an inner conductive core extending according to an axial direction within the outer core and forming with this core a succession of concentric crenelations according to an axial direction defining successive sections of low characteristic impedance coaxial lines and high characteristic impedance coaxial lines.

BACKGROUND OF THE INVENTION

The work "Microwave Filters, Impedance-Matching Networks and Coupling Structures", McGraw-Hill, 1962, describes such a microwave filter, in particular a low-pass filter, in which the outer conductive core is normally constituted by a cylindrical metal rod carrying concentric metal disks spaced according to the axial direction, the metal disks forming the succession of concentric crenelations. The cross-section of the inner core thus varies according to the axial direction so that each section of the large diameter inner core (corresponding to a metal disk) defines a section of coaxial line of very low impedance and each section of inner core of smaller diameter (corresponding to the interval between two consecutive disks) defines a section of coaxial line of high impedance. The dimensions of the sections are adjusted so as to realize the transfer function of the filter. However, the realization of such a coaxial structure microwave filter proves to be complex and costly, particularly for maintaining the inner core and the outer core of the filter perfectly coaxial. Spacers made from plastic or another dielectric material are generally used to maintain them coaxial but this introduces dielectric losses.

SUMMARY OF THE INVENTION

The invention proposes a coaxial structure microwave filter of a simpler and less expensive construction suitable for low cost volume production.

For this purpose, the invention relates to a coaxial structure microwave filter constituted by a tube of synthetic foam material, the tube presenting a constant internal diameter and a fully metallized external surface with, in the axial direction, a profile according to a periodic or constant function and by a bar of a fully metallized synthetic material, with a constant external profile or following a periodic function, the largest diameter of the bar being noticeably equal to the internal diameter of the tube so that the bar can be inserted into the tube while maintaining the tube and the bar coaxial. The foam used is preferably a polymethacrylimide foam known for its electrical characteristics approaching those of air, for its mechanical characteristics of rigidity and lightness and for its low cost price. In particular, a polymethacrylimide foam under the name of polymethacrylimide HF (high frequency) can be used.

According to the particularities of a filter according to the invention:

- The periodic or constant function per part depends on crenelations, the crenelations being able to have dimensions that differ from one crenelation to another.
- The thickness of the tube is chosen to maintain electrical insulation between the metallized surface of the tube and the bar With this construction, a microwave filter can easily be combined with a monopole type or dipole type antenna.

The invention extends to a method of producing a microwave filter as defined above according to which the periodic function is realized by thermoforming the foam tube or foam bar. In particular, as a thermoforming technique, hot press molding will preferably be used, which is adapted to an objective of high volume, low cost production.

The metallization of the foam tube or foam bar is preferably a non-directive metallization by projection or brush.

BRIEF DESCRIPTION OF THE DRAWINGS

Embodiments of a filter according to the invention are described below and illustrated in the drawings.

DESCRIPTION OF PREFERRED EMBODIMENTS

Figure 1:
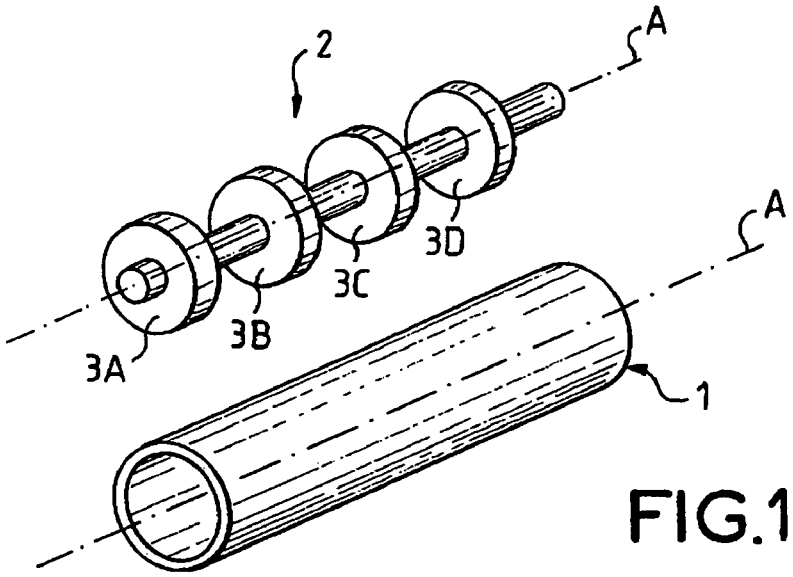
FIG. 1 shows an exploded perspective, in a highly schematic manner, of a first embodiment of a coaxial structure microwave filter according to the invention.

A first example of a coaxial structure microwave filter according to the invention is shown in FIG. 1 according to an exploded perspective view.

The outer conductive tube 1 and the inner conductive bar 2 of the filter are shown in FIG. 1 dissociated from each other for greater clarity, but it must be understood that the inner bar 2 extends according to the axial direction A inside the outer tube 1.

The inner bar 2 of the filter is constituted by a cylindrical bar made of synthetic foam whose outer surface follows a periodic function according to the axial direction. It preferably forms a succession of concentric crenelations 3A, 3B, 3C and 3D realizing the transfer function of the filter, for example a transfer function of a low-pass filter by defining successive sections of low characteristic impedance coaxial lines and high characteristic impedance coaxial lines. The shape of the foam bar 2 is realized by thermoforming, in particular according to a hot press molding technique. The outer surface is metallized by using a step of metal projecting or of metallic brushing (painting).

The outer tube 1 of the filter is constituted by a cylindrical tube of synthetic foam having a constant inner cross-section, the inner diameter of the tube being very slightly greater at the largest outer diameter of the foam bar 2 to allow the bar to be inserted into the tube. The cylindrical tube 1 has an outer surface fully metallized according to the technique described above. The thickness of the tube 1 is chosen to realize an electrical insulation between its outer metallized surface and the bar The synthetic material foam used is preferably a polymethacrylate imide foam.

The structure of the filter shown in FIG. 1 can be reinforced by two half-shells (not shown) surrounding the tube 1 that can be realized in a plastic material or in synthetic foam material.

Naturally, the tube 1 and foam bar 2 can have a cross-section other than circular, for example rectangular or square without falling outside the scope of the invention.

Figure 2:
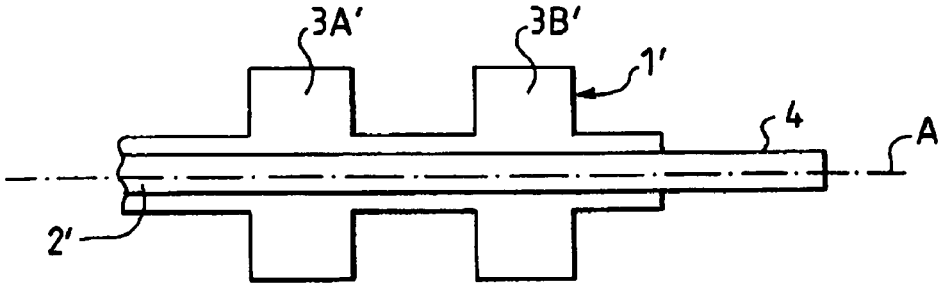
FIG. 2 schematically shows an axial section of a second embodiment of a coaxial structure microwave filter according to the invention associated with a monopole type antenna.

FIG. 2 shows another embodiment of a filter according to the invention. The outer tube 1' of the filter is constituted by a constituted by a cylindrical tube of synthetic foam material whose outer metallized surface is conformed to define the succession of crenelations 3A'-3B' according to the axial direction A whereas the inner bar 2' of the filter is constituted by a conductive cylindrical bar of constant cross-section. In this manner, the outer surface of the tube presents, according to the axial direction, a profile following a periodic or constant function by parts such as a crenelation function. The conductive bar 2' can consist of a solid or hollow cylindrical metal tube. The bar 2' can also be constituted by metallized synthetic material foam. In FIG. 2, the microwave filter according to the invention is associated with a monopole type antenna 4 constituted by an extension of the inner core 2' of the filter.

Figure 3:
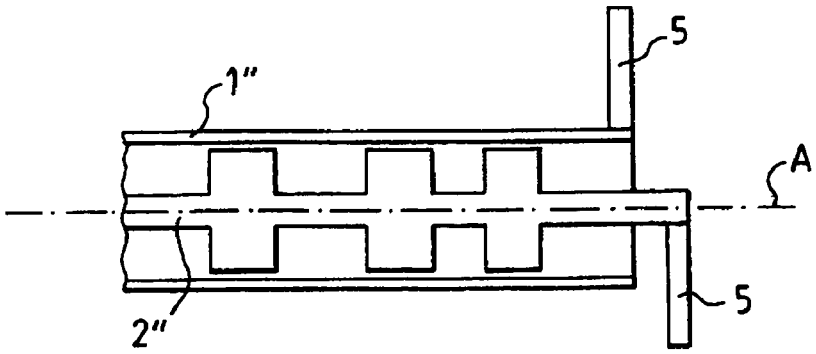
FIG. 3 schematically shows an axial section of a filter according to the first embodiment associated with a dipole type antenna.

FIG. 3 shows a microwave filter according to the invention that is similar to the filter shown in FIG. 1 with an outer foam tube 1" of constant cross-section and an inner bar constituted by a foam bar 2" of variable cross-section according to the axial direction A. Here, the filter is associated with a dipole type antenna 5.

The use of the metallized foam technique enables complex coaxial structure microwave filters to be realized at low cost.

The invention claimed is:

1. A coaxial structure microwave filter comprising a tube presenting a constant inner diameter and a fully metallized constant outer surface and an inner bar with a fully metallized outer profile following a periodic curve, the tube and the bar being realized in foam of a metallizable synthetic material with electrical characteristics approaching those of air, the inner bar having a largest diameter nearly equal to the inner diameter of the tube.

2. The filter according to claim 1, wherein the periodic curve includes a plurality of crenelations, the crenelations having dimensions identical from one crenelation to another.

3. The filter according to claim 1, wherein the periodic curve includes a plurality of crenelations, the crenelations having dimensions different from one crenelation to another.

4. A coaxial structure microwave filter comprising a tube presenting a constant internal diameter and a fully metallized outer surface with, in an axial direction, a profile following a periodic curve and an inner bar with a constant fully metallized outer profile, the tube and the bar being realized in foam of a metallizable synthetic material with electrical characteristics approaching those of air, a largest diameter of the bar being noticeably equal to the internal diameter of the tube.

5. The filter according to claim 4, wherein the periodic curve includes a plurality of crenelations, the crenelations having dimensions identical from one crenelation to another.

6. The filter according to claim 4, wherein the periodic curve includes a plurality of crenelations, the crenelations having dimensions different from one crenelation to another.

* * * * *